US005804274A

United States Patent [19]

Nordin

[11] Patent Number: 5,804,274

[45] Date of Patent: Sep. 8, 1998

[54] CLEANING CLOTH FOR CLEANING DIRTY SURFACES

[75] Inventor: Rudolf Nordin, Boraås, Sweden

[73] Assignee: Actuelle Tricot I Boras AB, Sweden

[21] Appl. No.: 809,505

[22] PCT Filed: Sep. 14, 1995

[86] PCT No.: PCT/SE95/01035

§ 371 Date: Mar. 24, 1997

§ 102(e) Date: Mar. 24, 1997

[87] PCT Pub. No.: WO96/10946

PCT Pub. Date: Apr. 18, 1996

[30] Foreign Application Priority Data

Oct. 7, 1994 [SE] Sweden ..... 9403398

[51] Int. Cl.[6] ..... B32B 3/02; A47K 7/02; A47L 13/10

[52] U.S. Cl. ..... 428/89; 15/208; 15/229.11

[58] Field of Search ..... 428/89; 15/208, 15/229.11

[56] References Cited

U.S. PATENT DOCUMENTS

| | | | |
|---|---|---|---|
| 3,030,691 | 4/1962 | Law | 428/89 |
| 3,126,572 | 3/1964 | Franey . | |
| 3,638,270 | 2/1972 | Schlehgel, Jr. et al. . | |
| 4,045,605 | 8/1977 | Breens et al. | 428/89 |
| 4,340,631 | 7/1982 | Endo et al. | 428/89 |
| 4,659,602 | 4/1987 | Birch | 428/89 |
| 4,820,566 | 4/1989 | Heine et al. | 428/89 |
| 4,906,513 | 3/1990 | Kebbell et al. . | |
| 5,055,333 | 10/1991 | Heine et al. | 428/89 |
| 5,525,393 | 6/1996 | Raab | 428/89 |
| 5,591,507 | 1/1997 | Jones | 428/89 |

FOREIGN PATENT DOCUMENTS

90/00209 1/1990 WIPO .

OTHER PUBLICATIONS

Patent Abstracts of Japan, vol. 17, No. 190, C–1048, Abstract of JP, A, 4–341230 (Toray Ind Inc) Nov. 27, 1992.
Patent Abstracts of Japan, vol. 17, No. 622, C–1130, Abstract of JP, A, 5–192284 (Daiwabo Create K.K.) Aug. 3, 1993.

*Primary Examiner*—Terrel Morris
*Attorney, Agent, or Firm*—Lerner, David, Littenberg, Krumholz & Mentlik

[57] ABSTRACT

The invention relates to a cleaning cloth for cleaning dirty surfaces comprising a base fabric having two sides with loops of yarn on each side. One side has longer loops of yarn having a normal fibre fineness and shorter loops of microfilament yarn for improved absorbency. The invention also relates to a mop having the cleaning cloth arranged thereon.

12 Claims, 1 Drawing Sheet

CLEANING CLOTH FOR CLEANING DIRTY SURFACES

FIELD OF THE INVENTION

The present invention relates to a cleaning cloth for cleaning dirty surfaces and a mop on which said cleaning cloth is arranged.

PRIOR ART

A vast number of arrangements for cleaning or wiping dirty surfaces are known from time immemorial. The most usual device is perhaps a piece of cloth of different kinds but even more mechanised arrangements are in use, especially during recent time. Vertical, horizontal and also sloping surfaces have to be cleaned from time to time and the arrangements for carrying out the cleaning work vary greatly due to the position, shape and nature of the surfaces. A common and very much used device for cleaning floor surfaces is a so-called mop.

A mop consists principally of an extended shaft at the lower end of which a disc is hingedly attached and at the underside of which the cleaning device itself, for example a piece of cloth, is arranged. The mops are usually used in such a way that they are wetted or dipped into water and they are pulled or pushed over a floor, whereby the dirt is partly dissolved and partly withdrawn with the mop. After the cleaning of the floor has been completed by means of the mop, the water is evaporated together with possibly volatile solvents, however, leaving a covering film consisting of first dissolved and then dried dirt.

TECHNICAL PROBLEM

Use of pieces of cloth and mops may often per se give an acceptable result. With regard to cloths it is, however, often necessary to wipe with more cloths successively and with regard to mops the above-mentioned film of dirt will be left. A further problem is that there must exist a certain friction between the support which is to be cleaned and the cleaning tool but this friction must not be too large, which means that an optimisation of the friction is desirable.

THE SOLUTION

It has therefore for a very long time been a wish to improve the cleaning cloth and, for example, mops with cleaning cloth attached at the underside so that the cleaning becomes better and less strenuous.

According to the present invention a cleaning cloth for cleaning dirty surfaces has accordingly been brought about, which cleaning cloth is characterized by a base fabric having on one side longer loops of yarn with a normal fibre fineness and shorter loops of microfilament yarn having great dirt and liquid absorption ability and at the other side substantially microfilament yarn with great liquid absorption ability, preferably in the shape of short loops.

According to the invention it is suitable that the base fabric is a woven or knitted cloth consisting wholly or partly of microfibres or microfilaments.

It is further suitable according to the invention that the shorter loops consist of yarn of microfilaments or microfibres having a fineness of at most 1 Dtex.

The longer loops should, according to the invention, consist of yarn of filaments or staple fibres having a fineness of at least 1 Dtex.

The ratio between shorter and longer loops on one side of the cloth should be, according to the invention, such that 75%–25%, preferably 50% are made up by the shorter loops.

The microfilament yarns which are used according to the present invention consist suitably of synthetic fibres of polyester and polyamide, for example in a ratio of 70:30.

The yarn having a normal fibre fineness should, according to the present invention consist wholly or partly of synthetic fibres of polyester.

The cleaning cloth according to the present invention is used, according to a further aspect of the invention, on mops where the cloth is arranged on that side of the mop which faces the dirty surface.

The mop according to the present invention is further characterised in that the side of the cleaning cloth facing the dirty surface is the one which comprises both longer and shorter loops.

According to the invention it is suitable that the mop with the cleaning cloth is such that the cleaning cloth is sewn together with another cloth between which cloths a further one or more absorption layers for water, preferably in the shape of the cleaning cloth according to the invention, are arranged.

DESCRIPTION OF THE FIGURES

The invention will in the following be described more in detail in connection with the attached drawings where FIG. 1 in section shows a cleaning cloth according to the invention, where.

DETAILED DESCRIPTION

Figure 1:
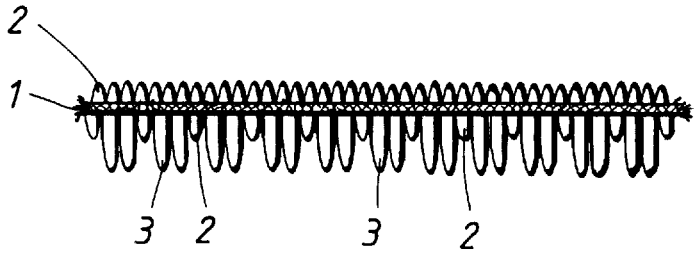

FIG. 1 shows a section through a cleaning cloth according to the invention. It consists of a base fabric 1 and shorter loops 2 at either side of the base fabric 1 and longer loops 3 on one side of the base fabric 1. The fabric may be woven or knitted with loops on both sides. It can, however, instead of having woven loops, be provided with yarn loops attached by sewing whereby loops are formed. The loops having the shorter length may also be replaced by the same material in another shape on that side which does not comprise long loops.

All yarns present in the cleaning cloth are suitably of synthetic material.

The base fabric, which suitably is woven or knitted consists of microfibres or microfilaments or usual filaments. If microfilaments are used, the material composition consists suitably of 70% polyester and 30% polyamide and the fineness of the filaments is suitably about 0.3 Dtex. The microfilament yarn consists of 1 050 filaments per thread which gives a fineness of 330 Dtex per yarn thread.

The base fabric may also comprise 100% polyester filament yarn with a fineness per filament of 5.8 Dtex, making a fineness of about 280 Dtex for a thread consisting of 48 filaments.

The loops 2 having a shorter size consist of yarn of many and very fine fibres or filaments, which are so thin that according to terminological practice they are named micro, i.e. they have a fineness which is lower than 1 Dtex. The loops 3 having a longer length consist of yarn with a more normal fibre fineness, i.e. substantially above 1 Dtex. The yarn may be made of endless fibres (filaments) or be spun of staple fibres. The spun yarn may be a single-ply yarn or composed of many threads twisted together.

The ratio between the longer and shorter loops per surface unit on the side of the cloth which has both long and short loops is suitably between 75% and 25%, preferably 50%. An even distribution of short and long loops is preferred.

The material of the cloth, construction and yarn and the fibre formation result in unique properties for cleaning purposes. When the side of the cloth having different lengths of loops is pulled over a surface, the longer loops will have a brushing or sweeping effect and the shorter loops with microfilament yarn will have an absorbing and accumulating effect on dust and dirt particles as well as humidity on the wiped surface. The microfibre loops on both sides of the cloth as well as the yarns of the base fabric having such fibres have, due to their very large number of fibres and their flat form, a very great total material surface of synthetic fibre material.

In a dry condition the static electrical effect will attract dust and dirt particles which are bound to and between the fibre surfaces.

In a wet condition liquid is bound around the surface layer of the fibres and capillarily between them.

The longer loops with their brushing and sweeping effect have by themselves a certain absorption ability but have primarily the function of transferring dust, dirt and humidity to the microfibres having a greater attraction force and ability to accumulate. Due to the strong absorption forces, the microfibres will function, in loops of this surface layer as well as in the loops on the reverse side of the cloth and in the yarn of the base fabric, in the absorption and accumulation process from the cleaned surface.

Another important function is the friction of the cloth against the surface which is to be cleaned. Due to the extremely large total fibre surface of the cloth and the shape of the separate microfilaments the friction against the support will be much too large for practical work during a longer period if the abutting surface consists completely of microfilaments. This would be the case especially when humidity was used. A certain friction is, however, preferred for effective cleaning work. The longer loops with their coarser fibres of more round shape have an appreciably lower friction against the support. They are also longer with the intention that, besides having a brushing property on a not completely even surface, the cloth shall ride on these loops when being pulled over a support. An adjustment of the material, length, and proportion of these longer loops will optimise the properties of the cloth with regard to friction, brushing and accumulation.

Another important property of the synthetic material is that humidity is bound to the material surfaces and capillarily between them and to a very small extent molecularly within the fibres as is the case with, for example, cotton. Humidity can therefore actively participate in the cleaning work if the material is wetted before use when the cleaning is carried out with humidity.

The good absorption and retention properties of the cloth cause very little humidity to remain on the clean surface in spite of the fact that the humidity content through the microfibres in the material is so large that it suffices for cleaning large surfaces.

The cloth material may also advantageously be used when cleaning where a larger amount of humidity or liquid is required. A dry or wrung-out cloth may then be used after cleaning.

Examples of the short loops are microfilament yarns having 330 Dtex with a fineness per filament of about 0.3 Dtex and a material composition of 70% and 30% polyamide.

The longer loops consist, for example, of spun yarn of staple fibres in 100% polyester with a yarn fineness of about 300 Dtex and a fibre fineness of 1.5 Dtex per fibre. The yarn may be single or consist of two finer yarns twisted together which give a fineness of about 300 Dtex.

Figure 2:
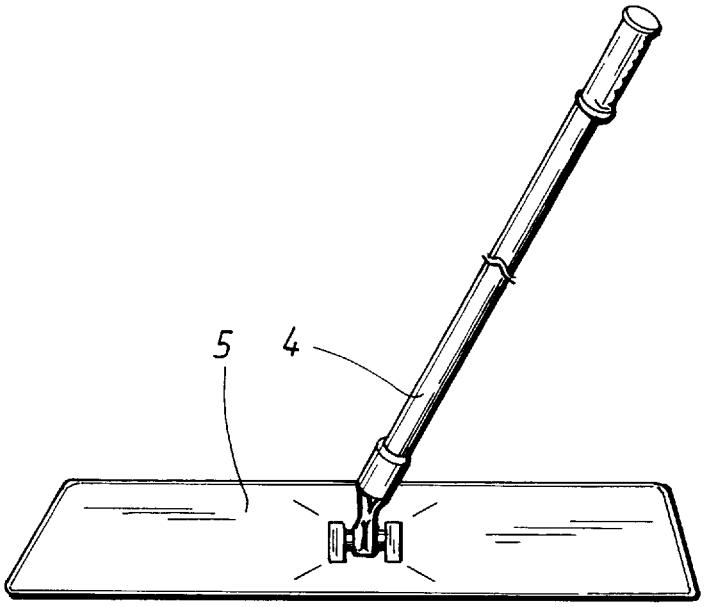
FIG. 2 shows a principal design of a mop and where
Figure 3:
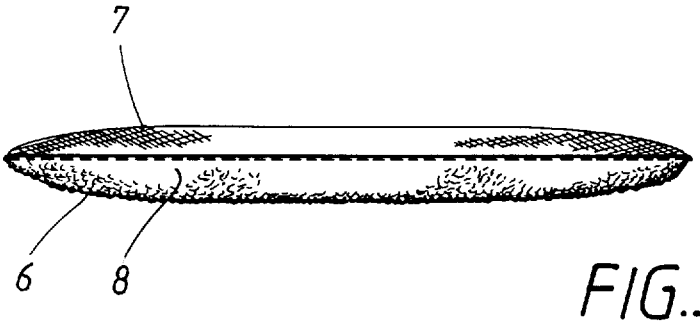
FIG. 3 shows an example of use of the cleaning cloth according to FIG. 1.

FIG. 2 shows a mop to be used with the cleaning cloth according to the invention. The mop consists principally of a telescopic pipe or shaft 4 which is hingedly connected with a disc 5 of aluminium or similar material. Velcro tape "males" moulded in grooves are inserted on the underside of the disc. When the mop is used, the aluminium disc 5 with the Velcro bands on the underside is simply pressed against the element of cleaning cloth which is to be used and the mounting is thereby complete. If the cleaning element is to be removed it is possible to press one's foot against it and push off the aluminium disc 5.

To use the mop in this way with Velcro tapes it is therefore necessary that the upper side of the cleaning element is constructed to serve as a female at the attachment with the Velcro tape. It is therefore suitable, according to the invention, to sew together the cleaning cloth 6 with a cloth 7 which is intended to be the upper side which has the properties of being able to be attached to the Velcro bands. Between these cloths 6 and 7 it is possible to arrange further absorption layers for water. This can suitably be done by inserting one or more layers of the cleaning cloth 6 according to the invention but even other absorption layers may be used.

The invention is not limited to the embodiments shown above but can be varied in different ways within the scope of the claims. Thus, even long loops 3 may be used on that side of the cleaning cloth where only the short loops 2 are shown in FIG. 1. However, this will give a lower water absorption ability than if only the short loops 2 are used. Moreover, the material in the short fibres 2 does not need to be in the shape of loops but may be arranged in another way making the absorption material. Also the base fabric 1 may consist of such an absorption element if it is produced from microfilaments.

I claim:

1. A cleaning cloth for cleaning a dirty surface, comprising:

(a) a base fabric having a first side for facing said dirty surface and a second side;

(b) a plurality of first loops of yarn having a fiber fineness of at least about 1 Dtex on said first side of said base fabric;

(c) a plurality of second loops of yarn comprising microfilament yarn with a fiber fineness of up to about 1 Dtex on said first side of said base fabric whereby said first side of said base fabric has improved dirt and liquid absorbency, said plurality of first loops of yarn having a length longer than said plurality of second loops of yarn; and (d) microfilament yarn with a fiber fineness of up to about 1 Dtex on said second side of said base fabric, whereby said second side of said base fabric has improved liquid absorbency.

2. The cleaning cloth of claim 1, wherein said plurality of first loops of yarn comprise filaments.

3. The cleaning cloth of claim 1, wherein said plurality of first loops of yarn comprise staple fibers.

4. The cleaning cloth of claim 1, wherein said base fabric is woven, and where said microfilament yarn on said second side of said base fabric comprises a plurality of third loops of said yarn.

5. The cleaning cloth of claim 4, wherein said base fabric at least partly comprises microfilament yarn.

6. The cleaning cloth of claim 1, wherein said plurality of second loops of yarn comprises between about 75% and 25% of the total number of said plurality of first and second loops of yarn on said first side of said base fabric.

7. The cleaning cloth of claim 6, wherein said plurality of second loops of yarn comprises 50% of the total number of said plurality of first and second loops of yarn on said first side of said base fabric.

8. The cleaning cloth of claim 1, wherein said microfilament yarn comprises synthetic fibers of 70% polyester and 30% polyamide.

9. The cleaning cloth of claim 1, wherein said plurality of first loops of yarn comprise fibers of synthetic polyester.

10. A mop for cleaning dirty surfaces comprising a base member and a cleaning cloth affixed to said base member, said cleaning cloth comprising the cleaning cloth of claim 1.

11. The mop of claim 10, including a second cloth sewn together with said cleaning cloth and disposed between said base member and said cleaning cloth.

12. The mop of claim 11, including at least one absorbent layer operatively arranged between said cleaning cloth and said second cloth.

* * * * *

UNITED STATES PATENT AND TRADEMARK OFFICE

CERTIFICATE OF CORRECTION

PATENT NO. : 5,804,274

DATED : September 8, 1998

INVENTOR(S) : Nordin

It is certified that error appears in the above-identified patent and that said Letters Patent is hereby corrected as shown below:

On the title page, line [75] "Boraås" should read -- Borås--.

Signed and Sealed this

Twenty-third Day of February, 1999

*Attest:*

Q. TODD DICKINSON

*Attesting Officer*

*Acting Commissioner of Patents and Trademarks*